United States Patent [19]

Pesiri

[11] Patent Number: 4,979,298

[45] Date of Patent: Dec. 25, 1990

[54] SHAVING SYSTEM

[75] Inventor: Richard S. Pesiri, Milton, Mass.

[73] Assignee: The Gillette Company, Boston, Mass.

[21] Appl. No.: 507,611

[22] Filed: Apr. 10, 1990

[51] Int. Cl.[5] ..... B26B 21/00; A45D 27/26

[52] U.S. Cl. ..... 30/49; 30/346.5

[58] Field of Search ..... 30/49, 50, 41, 32, 346.5, 30/346.59

[56] References Cited

U.S. PATENT DOCUMENTS

| | | | |
|---|---|---|---|
| 2,556,208 | 6/1951 | Musso | 30/49 X |
| 2,598,711 | 6/1952 | Musso | 30/49 |
| 2,614,321 | 1/1952 | Ackerman | 30/49 X |
| 3,702,026 | 11/1972 | Scholin | 30/49 |
| 4,807,360 | 2/1989 | Cerier et al. | 30/49 |
| 4,875,288 | 10/1989 | Trotta et al. | 30/49 |

FOREIGN PATENT DOCUMENTS 598803 10/1959 Italy .

WO88/0498-80 7/1988 PCT Int'l Appl. .

*Primary Examiner*—Douglas D. Watts

*Attorney, Agent, or Firm*—Fish & Richardson

[57] ABSTRACT

A shaving system of the wet shave type includes a support member that has a skin engaging surface in which a plurality of spaced apertures are defined. A blade unit has a generally tubular upstanding body portion of predetermined height that defines a central aperture, an integral, inwardly facing flange at one end that has a continuous sharpened shaving edge, and integral outwardly extending flange structure adjacent the opposite end of the tubular body. Depending latch structure is formed integrally with the support member and aligned with each aperture, and integral support structure disposed between the latch structure and the skin engaging surface receives and guides the body portions of the blade units with the latch structure engaging the outwardly extending flange structures of the blade units to secure the blade units in the support member.

20 Claims, 3 Drawing Sheets

7
7
18
18
40
42
44

14
16
22
46
46
48
50
52
54

42
48
50
52
54

SHAVING SYSTEM

This invention relates to shaving systems of the wet shave type, and more particularly to a shaving system with a plurality of individual razor blade members disposed in a compact spaced array in a shaving surface, each blade member having an annular cutting edge, a shaving system of this type being shown in U.S. Pat. No. 4,807,360 for example.

In accordance with the invention, there is provided a shaving system of the wet shave type that includes a support member that has a skin engaging surface in which a plurality of spaced apertures are defined. A blade unit is disposed in each aperture, each blade unit having a generally tubular upstanding body portion of predetermined height that defines a central aperture, an integral, inwardly facing flange at one end that has a continuous sharpened shaving edge, and integral outwardly extending flange structure adjacent the opposite end of the tubular body. Depending latch structure is formed integrally with the support member and aligned with each aperture, and support structure is disposed between the latch structure and the skin engaging surface that receives and guides the body portions of the blade units with the latch structure engaging the outwardly extending flange structures of the blade units to secure the blade units in the support member.

Preferably, the blade unit support member is of polymeric material, there is at least one blade unit per square centimeter of the skin engaging surface of the blade unit support member, the support structure associated with each aperture defines a series of spaced axially extending guide and aligning surfaces which conform to outer surfaces of the tubular body portion of the blade unit disposed therein and seat surface structure for the outwardly facing flange structure of the blade unit, the guide and aligning surfaces being disposed between the latch structure and the skin engaging surface for providing lateral positioning of the blade units in the support member, and the latch structure includes spaced outwardly deflectable capture portions.

In preferred embodiments, the tubular blade body portion of each blade unit is cylindrical, and each guide and aligning surface is of concave configuration and mates with the outer surface of the body portion of the blade unit and has a length that is at least one half the axial length of the tubular blade body portion. In particular embodiments, the latch structure is of sleeve configuration, and includes a plurality of planar flexible web portions that are interconnected by curved portions that conform with the outer edge of the outwardly facing flange structure.

In a particular embodiment, each aperture in the skin engaging surface is of generally hexagonal configuration, each blade unit is of metal of less than 0.2 millimeter thickness, the diameter and axial length of the body portion of each blade unit are each less than one centimeter, its outwardly facing flange structure is of continuous circular configuration and of about one millimeter greater diameter than the diameter of its tubular body, and each sharpened edge is of continuous annular configuration and is disposed less than one half millimeter above the skin engaging surface.

The invention provides reliable securing of blade units in the support member, provides a shaving system in which the skin engaging surface may flex and better conform to the skin surface being shaved if desired, and facilitates effective and economical assembly of the shaving system using mass production techniques.

Other features and advantages of the invention will be seen as the following description of a particular embodiment progresses, in conjunction with the drawings, in which.

DESCRIPTION OF PARTICULAR EMBODIMENT

Figure 1:
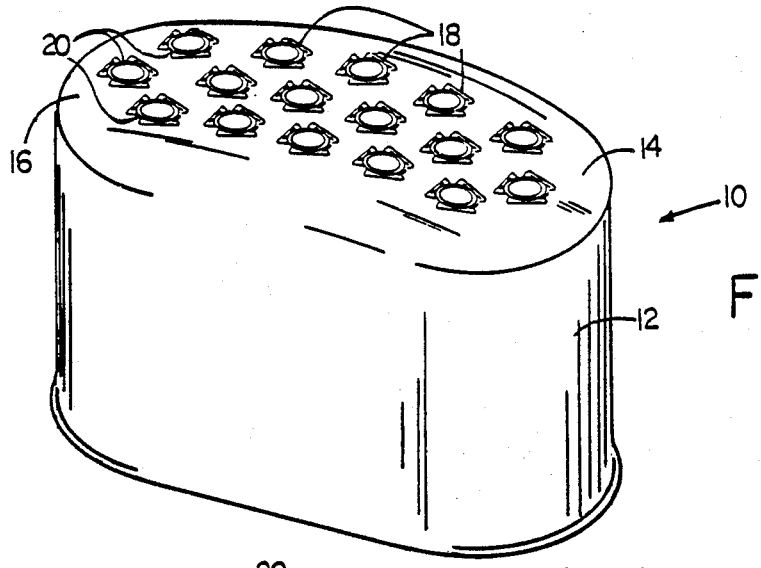
FIG. 1 is a perspective view of a shaving system in accordance with the invention.
Figure 2:
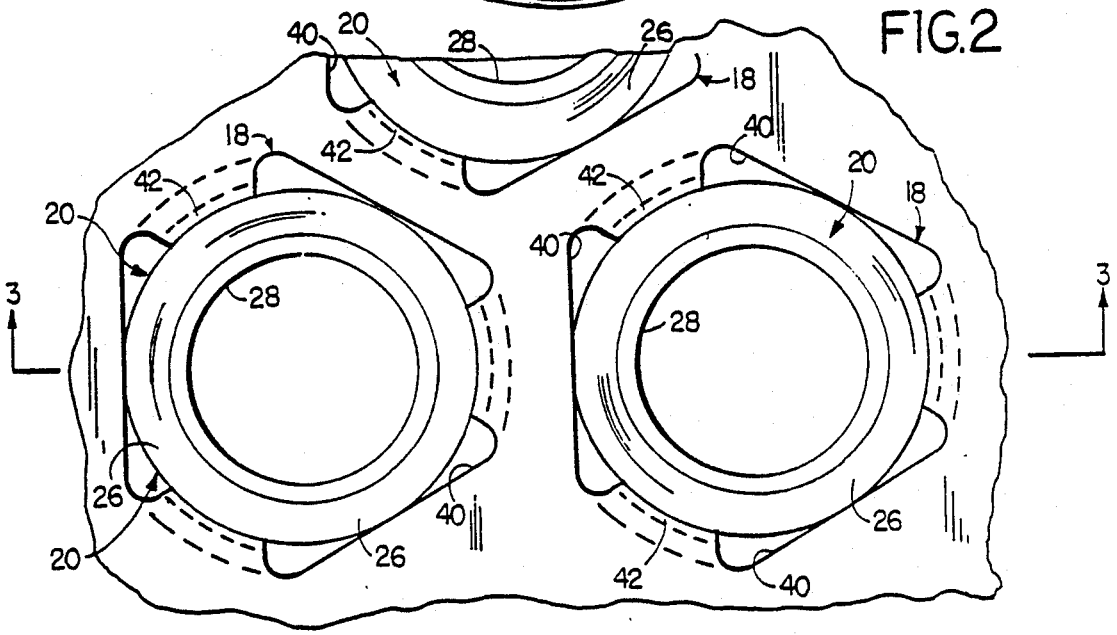
FIG. 2 is an enlarged top view of a portion of the shaving system shown in FIG. 1.
Figure 3:
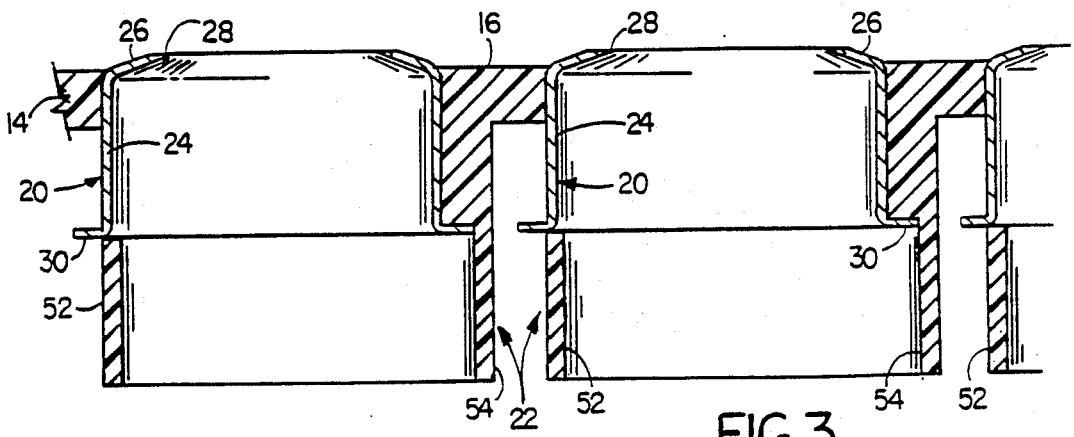
FIG. 3 is a sectional view taken along the line 3—3 of FIG. 2 of two blade units and a portion of the support surface of the shaving system of FIG. 1.

The razor 10 shown in FIGS. 1–3 includes head portion 12 that is molded of polymeric material such as polypropylene (and which may be detachable from a handle or include an integral grip portion) and has flexible transverse support 14 of about 0.6 millimeter thickness that provides skin engaging surface 16 of convex configuration. Formed in support 14 is an array of sixteen apertures 18 of generally hexagonal configuration in which tubular blade units 20 are disposed. Apertures 18 are disposed in three rows and spaced about six millimeters on center in each row, adjacent rows being spaced about five millimeters on center. Integral with support 14 and aligned with each aperture 18 is depending guide and latch structure 22, as indicated in FIG. 3.

Figure 4:
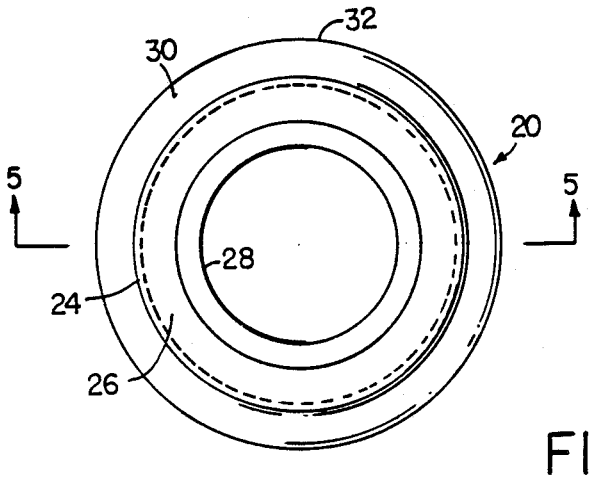
FIG. 4 is a top plan view of a blade unit.
Figure 5:
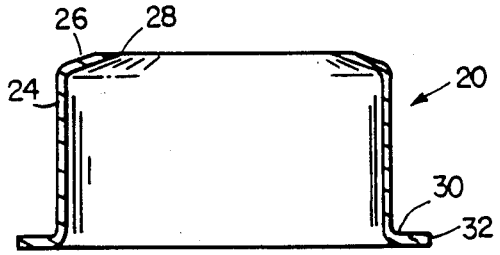
FIG. 5 is a sectional view taken along the line 5—5 of FIG. 4.

Each blade unit 20, as indicated in FIGS. 4 and 5, is of 0.1 millimeter thick stainless steel and has a cylindrical body portion 24 of about four millimeters diameter and about 2.5 millimeter height; upper flange 26 that is inclined upwardly at an angle of twenty degrees and has a length of about 0.75 millimeter and defines sharpened shaving edge 28 of about 2.5 millimeter diameter; and horizontal lower flange 30 whose outer edge 32 has a diameter of about five millimeters.

Figure 6:
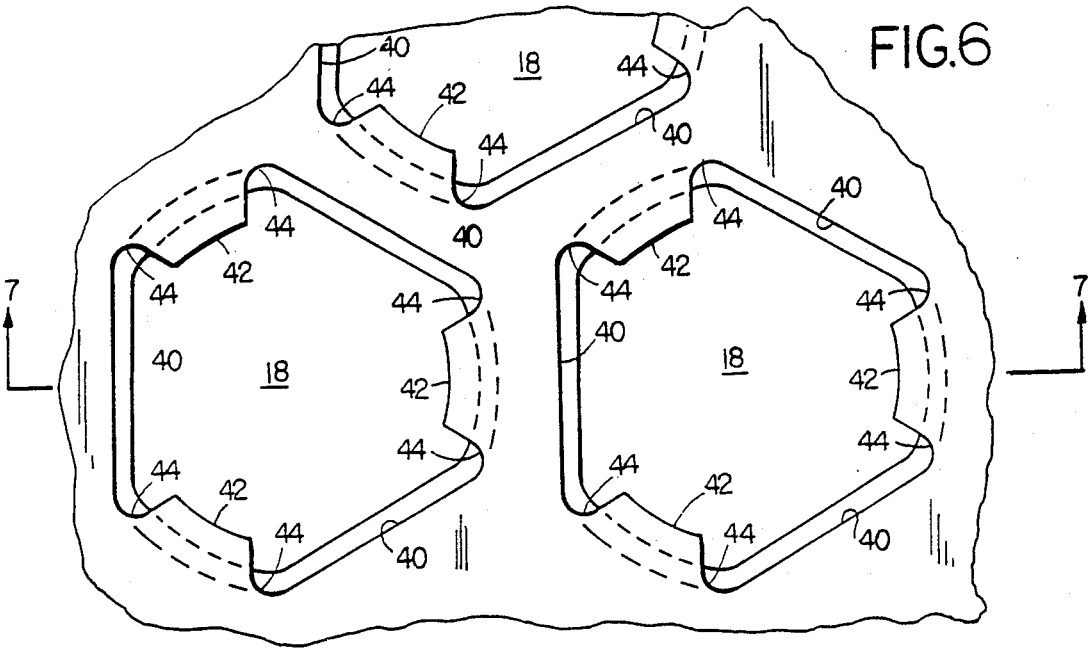
FIG. 6 is a top plan view of a portion of the support structure of the shaving system shown in FIG. 1.
Figure 7:
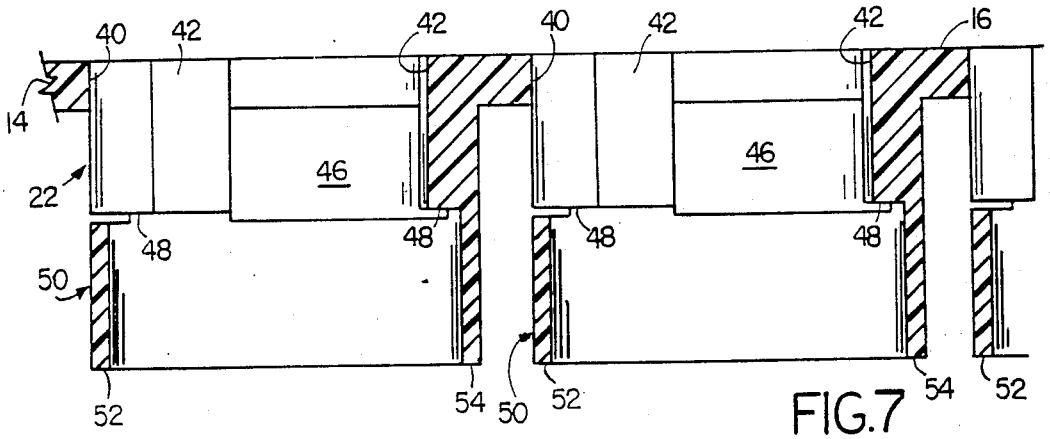
FIG. 7 is a sectional view taken along the line 7—7 of FIG. 6.
Figure 8:
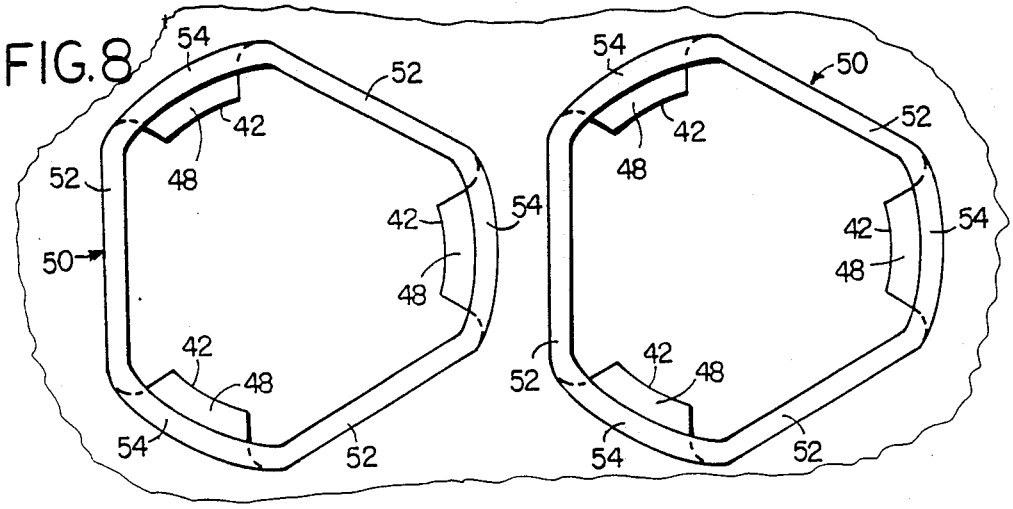
FIG. 8 is a bottom view of the portion of the support structure shown in FIG. 6.

As indicated in the views of FIG. 6–8, each aperture 18 at the skin engaging surface 16 includes three straight portions 40, three concave guide and support pad portions 42 and curved transition portions 44 that connect portions 40 and 42. Each guide and support pad portion 42 is disposed on a circle of four millimeters radius (the outer diameter of blade body 24), has an arcuate length about 30°, and extends axially downwardly about two millimeters; and each straight portion 40 is perpendicular to a radius from the center of the aperture at a radial distance of about 2.2 millimeters. Open spaces 46 are formed below straight portions 40 between guide and support pads 42, and each guide and support pad 42 has a seat surface 48 at its lower end.

Depending from each support and guide pad 42 is annular latch sleeve structure 50 of about 0.25 millimeter thickness, about 1.5 millimeters length, and shaped as indicated in FIGS. 7 and 8. Flexible latch web portions 52 correspond to perimeter straight portions 40 of the apertures 18 in skin engaging surface 16 and are connected by curved sleeve portions 54. Each curved sleeve portion is integrally connected to a support projection 42 and has a radius of about 2.5 millimeter.

In assembly, the blade units 20 are inserted axially upwardly into depending latch sleeves 50 towards skin engaging surface 16, with body portions 24 engaging the concave guide portions 52 for aligning guidance, and flanges 30 engaging the curved portions 54 of sleeve 50 and flexing straight flexible latch web portions 52 outwardly. The blade units 20 are further axially inserted until their flanges 30 are seated against the lower surfaces 48 of guide projections 42. The latch webs 52 then snap back to the position indicated in FIGS. 3 and 7 to secure the blade units 20 in the position indicated in FIGS. 3 and 7 with blade edge 28 disposed about 0.2 millimeter above skin engaging surface 16. Each blade unit 20, as secured in support 14, is not dislodged by a sixteen pound axial force, and the skin engaging surface 16 may flex and conform to convex and concave skin surfaces being shaved without dislodging any of the blade units. Multiple blade units may be inserted simultaneously using mass production equipment.

While a particular embodiment of the invention has been shown and described, various modifications thereof will be apparent to those skilled in the art, and therefore is not intended that the invention be limited to the disclosed embodiment or to details thereof and departures to be made therefrom within the spirit and scope of the invention.

What is claimed is:

1. A shaving system of the wet shave type comprising a support member that has a skin engaging surface in which a plurality of spaced apertures are defined, a blade unit disposed in each said aperture, each said blade unit having a generally tubular upstanding body portion of predetermined height that defines a central aperture, an integral, inwardly facing flange at one end that has a continuous sharpened shaving edge, and integral outwardly extending flange structure adjacent the opposite end of said tubular body, depending latch structure formed integrally with said support member and aligned with each aperture, and support structure formed integrally with said support member and disposed between said latch structure and said skin engaging surface that receives and guides said body portions of said blade units with said latch structure engaging said outwardly extending flange structures of said blade units to secure said blade units in said support member.

2. The system of claim 1 wherein said support structure associated with each said aperture defines a series of spaced axially extending guide and aligning surfaces which conform to outer surfaces of the tubular body portion of the blade unit disposed therein for providing lateral positioning of said blade units in said support member.

3. The system of claim 2 wherein each said tubular blade body portion is cylindrical, and each said guide and aligning surface is of concave configuration and at least one half the axial length of said tubular blade body portion.

4. The system of claim 1 wherein said latch structure is of sleeve configuration.

5. The system of claim 1 wherein said latch structure includes a plurality of planar flexible web portions that are interconnected by curved portions that conform with the outer edge of said outwardly facing flange structure.

6. The system of claim 1 wherein said outwardly facing flange structure is continuous and of circular configuration.

7. The system of claim 1 wherein there is at least one of said blade units per square centimeter of said skin engaging surface.

8. The system of claim 1 wherein the body portion of each said blade unit has a diameter of less than one centimeter and an axial length of less than one centimeter, and each said sharpened edge is of continuous annular configuration and is disposed less than one half millimeter above said skin engaging surface.

9. The system of claim 1 wherein each said 2 blade unit is of metal of less than 0.3 millimeter thickness, and said outwardly facing flange structure has a diameter of about one millimeter greater than the diameter of said tubular body.

10. The system of claim 1 wherein said latch structure includes spaced outwardly deflectable capture portions and said support structure includes seat surface structure against which said outwardly facing flange structure of said blade unit is seated when secured by said deflectable capture portions.

11. The system of claim 1 wherein said support structure includes concave guide surface structure that mates with the outer surface of the body portion of said blade unit.

12. The system of claim 1 wherein said support structure includes an array of at least five apertures.

13. The system of claim 12 wherein said latch structure includes spaced outwardly deflectable capture portions; and said support structure includes seat surface structure against which said outwardly facing flange structure of said blade unit is seated when secured by said deflectable capture portions, and concave guide surface structure that mates with the outer surface of the body portion of said blade unit.

14. The system of claim 13 wherein said support structure associated with each said aperture defines a series of spaced axially extending guide and aligning surfaces which conform to outer surfaces of the tubular body portion of the blade unit disposed therein for providing lateral positioning of said blade units in said support member.

15. The system of claim 14 wherein each said tubular blade body portion is cylindrical, and each said guide and aligning surface is of concave configuration and at least one half the axial length of said tubular blade body portion.

16. The system of claim 15 wherein each said blade unit is of metal of less than 0.2 millimeter thickness, the body portion of each said blade unit has a diameter of less than one centimeter and an axial length of less than one centimeter, each said sharpened edge is of continuous annular configuration and is disposed less than one-half millimeter above said skin engaging surface, and each said outwardly facing flange structure is of continuous, circular configuration and has a diameter of about one millimeter greater than the diameter of said tubular body.

17. The system of claim 16 wherein said latch structure is of sleeve configuration, and includes a plurality of planar flexible web portions that are interconnected by curved portions that conform with the outer edge of said outwardly facing flange structure.

18. The system of claim 17 wherein said apertures are of generally hexagonal configuration and are spaced less than one centimeter on center, and there is at least one blade unit per square centimeter of said skin engaging surface.

19. The system of claim 12 wherein each said blade unit is of metal of less than 0.2 millimeter thickness, the body portion of each said blade unit is cylindrical and has an axial length and a diameter of less than one centimeter, each said sharpened edge is of continuous annular configuration and is disposed less than one half millimeter above said skin engaging surface, and each said outwardly facing flange structure is of continuous, circular configuration and has a diameter of about one millimeter greater than the diameter of said tubular body, each said guide and aligning surface is of concave configuration and at least one half the axial length of said tubular blade body portion, and said apertures are spaced less than one centimeter on center, and there is at least one blade unit per square centimeter of said skin engaging surface.

20. The system of claim 19 wherein said latch structure is of sleeve configuration, and includes a plurality of interconnected spaced outwardly deflectable planar flexible capture web portions; and said support structure includes seat surface structure against which said outwardly facing flange structure of said blade unit is seated when secured by said deflectable capture portions, and concave guide surface structure that mates with the outer surface of the body portion of said blade unit and defines a series of spaced axially extending guide and aligning surfaces that conform to outer surfaces of the cylindrical body portion of the blade unit disposed therein for providing lateral positioning of said blade units in said support member.

* * * * *